US009085811B2

(12) United States Patent
Okido et al.

(10) Patent No.: US 9,085,811 B2
(45) Date of Patent: Jul. 21, 2015

(54) METHOD FOR IMPROVING RESIDUAL STRESS IN PIPE AND METHOD FOR CONSTRUCTION MANAGEMENT

(75) Inventors: Shinobu Okido, Mito (JP); Naohiko Oritani, Hitachi (JP); Yuka Fukuda, Hitachi (JP); Satoru Aoike, Tokai (JP); Masaki Tsuruki, Tsuchiura (JP); Satoshi Kanno, Hitachi (JP)

(73) Assignee: HITACHI-GE NUCLEAR ENERGY, LTD., Ibaraki (JP)

( * ) Notice: Subject to any disclaimer, the term of this patent is extended or adjusted under 35 U.S.C. 154(b) by 653 days.

(21) Appl. No.: 13/080,686

(22) Filed: Apr. 6, 2011

(65) Prior Publication Data

US 2011/0247729 A1 Oct. 13, 2011

(30) Foreign Application Priority Data

Apr. 9, 2010 (JP) ..... 2010-089970
Jul. 14, 2010 (JP) ..... 2010-159270

(51) Int. Cl.
*C21D 9/08* (2006.01)
*C21D 11/00* (2006.01)

(52) U.S. Cl.
CPC ..... *C21D 9/08* (2013.01); *C21D 11/005* (2013.01); *C21D 2221/10* (2013.01)

(58) Field of Classification Search
CPC ..... C21D 9/08; C21D 11/005
USPC ..... 148/508
See application file for complete search history.

(56) References Cited

U.S. PATENT DOCUMENTS 4,229,235 A * 10/1980 Matsuda et al. ..... 148/520
4,354,883 A * 10/1982 Terasaki ..... 148/520

FOREIGN PATENT DOCUMENTS

| | | |
|---|---|---|
| JP | 54-094415 | 7/1979 |
| JP | 2005-023354 | 1/2005 |
| JP | 2005-320626 | 11/2005 |
| JP | 4196755 | 10/2008 |

OTHER PUBLICATIONS

Machine translation of JP 2005-320626 (Japanese document published on Nov. 17, 2005).*

* cited by examiner

*Primary Examiner* — Jessee Roe
*Assistant Examiner* — Christopher Kessler
(74) *Attorney, Agent, or Firm* — Baker Botts L.L.P.

(57) ABSTRACT

A method for improving a residual stress in a pipe includes improving the residual stress in the inner surface to the compressive direction by rapid cooling of the inner surface after heating of the pipe. The heating is to heat a vicinity of a welded part of the pipe from the outer surface to raise the temperature to a construction temperature. The rapid cooling is to rapidly cool the inner surface in the vicinity of the welded part by supplying cooling water into the pipe. The heating and the rapid cooling are repeated twice or more. A method for construction management includes determining whether construction has been executed properly based on a maximum value of a lowering rate of an outer surface temperature of the pipe when the cooling water is supplied for the rapid cooling of the inner surface and a thickness of the pipe in a measuring position of the outer surface temperature.

10 Claims, 8 Drawing Sheets

METHOD FOR IMPROVING RESIDUAL STRESS IN PIPE AND METHOD FOR CONSTRUCTION MANAGEMENT

CLAIM OF PRIORITY

The present application claims priority from Japanese Patent Application JP 2010-089970 filed on Apr. 9, 2010 and JP 2010-159270 filed on Jul. 14, 2010, the contents of which are hereby incorporated by reference into this application.

FIELD OF THE INVENTION

The present invention relates to a method for improving a residual stress applied to the inner surface of a pipe to the compressive direction and a method for construction management thereof.

BACKGROUND OF THE INVENTION

A residual stress in the tensile direction (tensile residual stress) possibly applies to the inner surface in the vicinity of a welded part of a pipe due to a heat history in welding. The tensile residual stress may cause generation and development of stress corrosion cracking in a high temperature water pipe made of austenitic stainless steel. Therefore, when a tensile residual stress applied to the inner surface in the vicinity of a welded part is improved to the compressive direction, or hopefully changed to a compressive residual stress, damage of a pipe due to stress corrosion cracking can be inhibited.

A method of rapid cooling of the inner surface after heating a pipe is one of the methods improving a tensile residual stress applied to the inner surface in the vicinity of a welded part of the pipe to the compressive direction. According to the method for improving a tensile residual stress to the compressive direction by rapid cooling of the inner surface after heating a pipe, the residual stress can be improved to the compressive direction even in a small diameter pipe which is with thin thickness and is hard to impart a great temperature difference between the inner and outer surfaces of the pipe because a temperature difference between the inner and outer surfaces is adjustable by adjusting the heating temperature.

Representative methods for improving a tensile residual stress applied to the inner surface to the compressive direction by rapid cooling of the inner surface after heating a pipe are disclosed in Japanese Published Unexamined Patent Application No. 54-94415, Japanese Patent No. 4196755, and Japanese Published Unexamined Patent Application No. 2005-320626. These documents describe methods for improving a tensile residual stress in the inner surface of a pipe to the compressive direction by supplying a coolant to the inside of a pipe after heating the pipe from the outer surface to a predetermined temperature and providing the inner surface of the pipe with a tensile yield stress by a thermal stress generated by a temperature difference between the inner and outer surfaces of the pipe.

Japanese Published Unexamined Patent Application No. 54-94415 discloses a method in which a tensile residual stress. applied to the inner surface of a pipe is relaxed or changed to a compressive stress by evenly heating entire group of pipes, thereafter allowing cooling material to flow into the pipe, thereby imparting a temperature difference between the inner and outer surfaces, and providing the inner surface with a tensile yield stress.

Japanese Patent No. 4196755 discloses a variation in a residual stress when a pipe after welding is heated to 200-900° C. (degrees Celsius), soaked for 1 hour, and air-cooled or water-cooled on the inner surface in order to reduce the residual stress. It also discloses that the reducing effect of the residual stress in the inner surface in the axial direction is greater as the heating temperature is higher and that the reducing effect of the residual stress is greater in water cooling of the inner surface than in air cooling. It is after the heating temperature exceeds approximately 600° C. that the residual stress in the inner surface in the axial direction becomes the compressive residual stress under the condition that the cooling method is water cooling of the inner surface.

Japanese Published Unexamined Patent Application No. 2005-320626 discloses a method for improving a tensile residual stress applied to the inner surface of a pipe to the compressive direction by uniformly heating the pipe and thereafter allowing a coolant to flow into the pipe, and thereby imparting a temperature difference between the inner and outer surfaces. It also discloses a method for specifying a minimum value of the cooling water quantity for each inside diameter of pipes as a method for construction management.

As described above, in order to inhibit damage of a pipe made of austenitic stainless steel due to stress corrosion cracking, it is necessary to improve a tensile residual stress generated by a heat history in welding to the compressive direction or hopefully to change the tensile residual stress to a compressive residual stress.

According to the methods for improving a residual stress to the compressive direction by rapid cooling of the inner surface after heating a pipe shown in the above-mentioned three documents, as shown in Japanese Patent No. 4196755, the reducing effect of the residual stress for the inner surface of a pipe improves as the heating temperature of a pipe is higher. This is because, as the heating temperature of the pipe rises, a temperature difference between the inner and outer surfaces of the pipe increases when water-cooling the inner surface. Since a generated thermal stress increases as the temperature difference increases, the amount of plastic deformation in the tensile direction generated in the inner surface of the pipe increases and the reducing effect of the residual stress improves.

However, it takes a long time to heat a pipe to a high temperature at a uniform temperature. Also, when a pipe is held at a high temperature for a long time, material deterioration, such as embrittlement of material and precipitation of carbide, may possibly occur according to the temperature band. For example, it is known that σ embrittlement occurs in the temperature band of 600° C.-900° C. in austenitic stainless steel. Possibly, 475° C. embrittlement may occur at a temperature in the vicinity of 475° C. even in austenitic stainless steel since a ferrite phase is included in a weld metal in the welded part. Accordingly, from the viewpoint of shortening the construction time and reducing material deterioration, it is preferable that the heating temperature of the pipe should be low. Therefore, it is a challenge for improving a residual stress to change a residual stress applied to the inner surface in the vicinity of the welded part to a compressive residual stress even when the heating temperature is low.

The object of the present invention is to provide a method for improving a residual stress and a method for construction management capable of changing a tensile residual stress applied to the inner surface in the vicinity of the welded part of a pipe to a compressive residual stress at a low construction temperature.

SUMMARY OF THE INVENTION

A method for improving a residual stress in a pipe according to an aspect of the present invention includes improving the residual stress in an inner surface of the pipe to the compressive direction by rapid cooling of the inner surface of the pipe after heating of the pipe. The heating is to heat a vicinity of a welded part of the pipe from an outer surface of the pipe to raise the temperature to a construction temperature. The rapid cooling is to rapidly cool the inner surface in the vicinity of the welded part of the pipe by supplying cooling water into the pipe. The heating and the rapid cooling are repeated twice or more.

According to the present invention, a tensile residual stress applied to the inner surface in the vicinity of a welded part of a pipe can be improved to a compressive residual stress. Therefore, by applying the present invention to a pipe for high temperature water (made of austenitic stainless steel, for example), occurrence of stress corrosion cracking can be inhibited. In addition, because of the low construction temperature, such effects can be achieved as well that 475° C. (degrees Celsius) embrittlement and a embrittlement do not occur and that the construction time can be shortened by shortening of the heating time.

DETAILED DESCRIPTION OF THE PREFERRED EMBODIMENTS

Figure 1A:
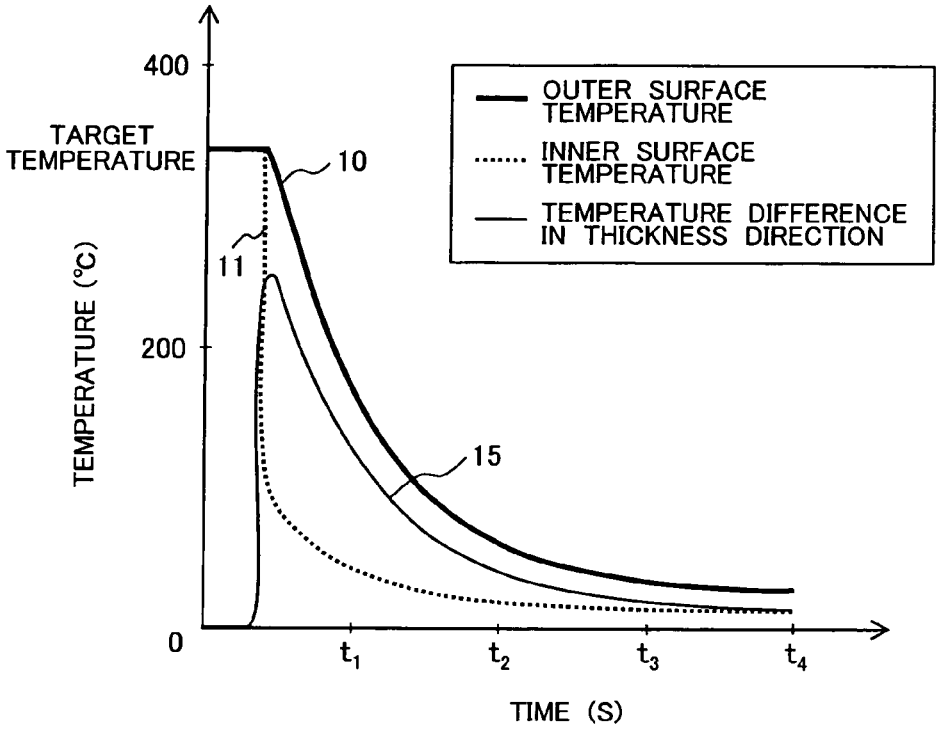
FIG. 1A shows an example of the time change of the temperature of the outer surface, the temperature of the inner surface, and the temperature difference in the thickness direction of a pipe during heat treatment.

Embodiments of a method for improving a residual stress in a pipe and a method for construction management according to the present invention will be described in detail. First, a heat treatment method in the method for improving a residual stress in a pipe will be described, and then the method for improving a residual stress in a pipe and the method for construction management will be described later.

The heat treatment method in the method for improving a residual stress in a pipe according to the present embodiment effectively changes a residual stress generated by welding or processing to a compressive residual stress by properly managing a temperature difference in the thickness direction of the pipe. The temperature difference in the thickness direction of a pipe means a difference between the temperature of the outer surface and the temperature of the inner surface of the pipe.

More specifically, a compressive residual stress field is formed in the inner surface of a pipe while keeping the temperature difference required for generating a residual stress in the thickness direction of the pipe by heating treatment, which heats the pipe to a predetermined target temperature, and by cooling treatment, which allows coolant to flow inside the pipe, without changing the strength characteristic of the material. It is preferable to set the target temperature in the range of 200-400° C. (degrees Celsius).

According to the present heat treatment method, the heat treatment time can be substantially shortened because the pipe is immediately cooled by allowing the coolant to flow inside the pipe after reaching the target temperature.

Because the temperature difference in the thickness direction during the heat treatment correlates to the cooling rate of the outer surface of a pipe, the temperature difference in the thickness direction can be properly managed by controlling the cooling rate of the outer surface. The cooling rate that can maintain the temperature difference in the thickness direction required for improving the residual stress (changing to a compressive residual stress) differs according to the outside diameter and the thickness of the pipe. For example, when the pipe is with 200 mm or below outside diameter and 15 mm or below thickness, the cooling rate of the outer surface is preferable to be 20° C./s (degrees Celsius per second) or above.

The present heat treatment method can be applied to a pipe of an arbitrary size, regardless of the outside diameter and thickness. Unfortunately, according to prior arts, a temperature difference in the thickness direction could not be sufficiently produced for a pipe with thin thickness. The present heat treatment method is featured to be applicable even to a thin pipe with the thickness of 15 mm or below. Further, from the viewpoint of heating efficiency, it is particularly effective for a pipe with the outside diameter of 200 mm or below and the thickness of 15 mm or below.

Examples of the coolant which is allowed to flow inside a pipe include water and liquid nitrogen.

Further, the temperature distribution in the peripheral direction of a pipe also can be managed by arranging one or more temperature measuring instruments on the outer surface of the pipe and monitoring changes in the outer surface temperature of the pipe.

Hereinafter, an embodiment of the present heat treatment method will be described in detail. The embodiment will be described referring to an exemplary case in which the pipe is made of austenitic stainless steel (SUS304 series, SUS316 series) and with the outside diameter of 200 mm or below and the thickness of 15 mm or below. The embodiment below will be described only for the case where the pipe made of austenitic stainless steel is used because the pipe is mostly made of austenitic stainless steel. Cooling water is used as a coolant allowed to flow inside the pipe.

FIG. 1A shows an example of the time change of the temperature 10 of the outer surface, the temperature 11 of the inner surface, and the temperature difference 15 in the thickness direction of a pipe during heat treatment, obtained using an experimental pipe. The temperature difference 15 in the thickness direction was obtained by subtracting the temperature 11 of the inner surface from the temperature 10 of the outer surface.

Figure 1B:
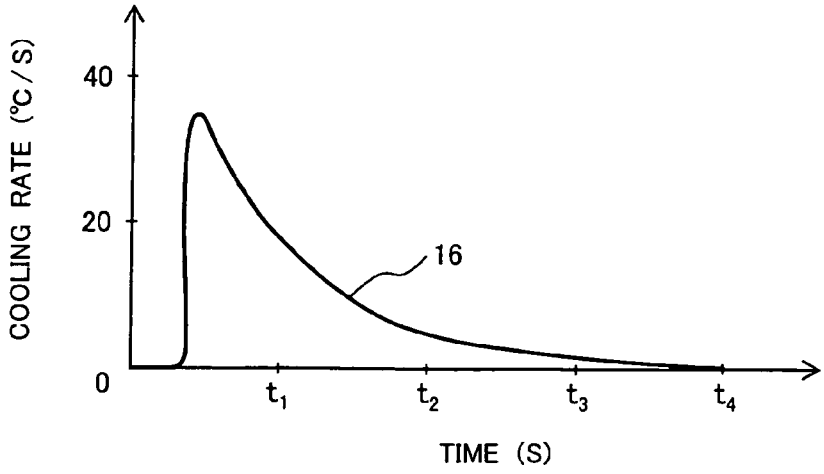
FIG. 1B shows an example of the time change of the cooling rate of the outer surface of the pipe during heat treatment.

FIG. 1B shows an example of the time change of the cooling rate 16 of the outer surface of the pipe during heat treatment, obtained using the experimental pipe similarly to the case of FIG. 1A. The cooling rate 16 of the outer surface of the pipe was obtained from the slope of a curve of the temperature 10 of the outer surface in each time.

In FIG. 1A and FIG. 1B, the temperature history is omitted while the temperature is raised. The condition to raise the temperature may be arbitrary as far as not providing the material with a thermal impact or local temperature difference. In the present embodiment, the pipe was heated to the target temperature by a heater.

After the pipe was heated to the target temperature, it was confirmed that there was no fluctuation of the temperature of the pipe, and thereafter the cooling water, which was a coolant, was allowed to flow inside the pipe. As shown in FIG. 1A, the temperature 10 of the outer surface and the temperature 11 of the inner surface nearly overlapped with each other until the cooling water was allowed to flow, but there was a big difference between them after the cooling water started to flow. That is, the temperature 11 of the inner surface sharply dropped immediately after the cooling water started to flow and lowered from the target temperature to the vicinity of 100° C. within several seconds. On the other hand, although the temperature 10 of the outer surface showed sharp drop immediately after the water was flowed, it lowered moderately, taking a time as long as approximately 4 times compared with the temperature 11 of the inner surface to drop to the vicinity of 100° C.

The temperature difference 15 in the thickness direction of the pipe showed the maximum value at the start of flow of the cooling water and dropped gradually thereafter with the nearly same inclination as the temperature 10 of the outer surface.

As shown in FIG. 1B, the cooling rate 16 of the outer surface, which was obtained from the temperature 10 of the outer surface of the pipe, changes with time with a tendency nearly same as the temperature difference 15 in the thickness direction. According to "Kikai Kougaku Binran Zairyou Rikigaku Kisohen" (Mechanical Engineering Handbook, Mechanics of materials, Basic), Nihon Kikai Gakkai (The Japan Society of Mechanical Engineers), 1994, when the temperature gradient (temperature difference between the inner and outer surfaces of the pipe) of ΔT exists in a hollow cylinder (pipe) with the inside radius a and the outside radius b, the thermal stress $\sigma_\theta$ in the peripheral direction and the thermal stress $\sigma_a$ in the axial direction generated in the inner surface are obtained by the equation (1);

$$\sigma_\theta = \sigma_a = \frac{\alpha \cdot E}{2(1-\nu)} \Delta T \cdot \beta_1 \tag{1}$$

where α is the coefficient of thermal expansion, E is the Young's modulus, ν is the Poisson's ratio, and $\beta_1$ can be expressed by the equation (2) below;

$$\beta_1 = \frac{2b^2}{b^2 - a^2} - \frac{1}{\ln(b/a)}. \tag{2}$$

As is apparent from the temperature difference 15 in the thickness direction of FIG. 1A, the temperature difference ΔT of approximately 250° C. was generated in the thickness direction by heat treatment according to the present embodiment. By substituting this temperature difference ΔT in the equation (1), the thermal stress of approximately 500 MPa was generated by this heat treatment.

When this thermal stress is equal to the yield stress of the pipe material or above and the residual stress caused by welding and processing is less than this thermal stress, the residual stress is distributed again by the present heat treatment, and a compressive residual stress is generated in the inner surface of the pipe.

On the other hand, when the residual stress caused by welding and processing is larger than this thermal stress, and if the temperature difference in the thickness direction of the pipe is further increased and the thermal stress is increased, the residual stress is distributed again by the present heating treatment, and a compressive residual stress is generated in the inner surface of the pipe. In order to increase the temperature difference in the thickness direction, a method of setting the target temperature in heating high and raising the heating temperature can be employed. When it is difficult to raise the heating temperature due to material characteristics of the pipe, lowering the temperature of the cooling water is also effective. Further, increasing the flow rate of the cooling water is also effective in cooling the inner surface of the pipe quicker and increasing the temperature difference in the thickness direction.

Figure 2:
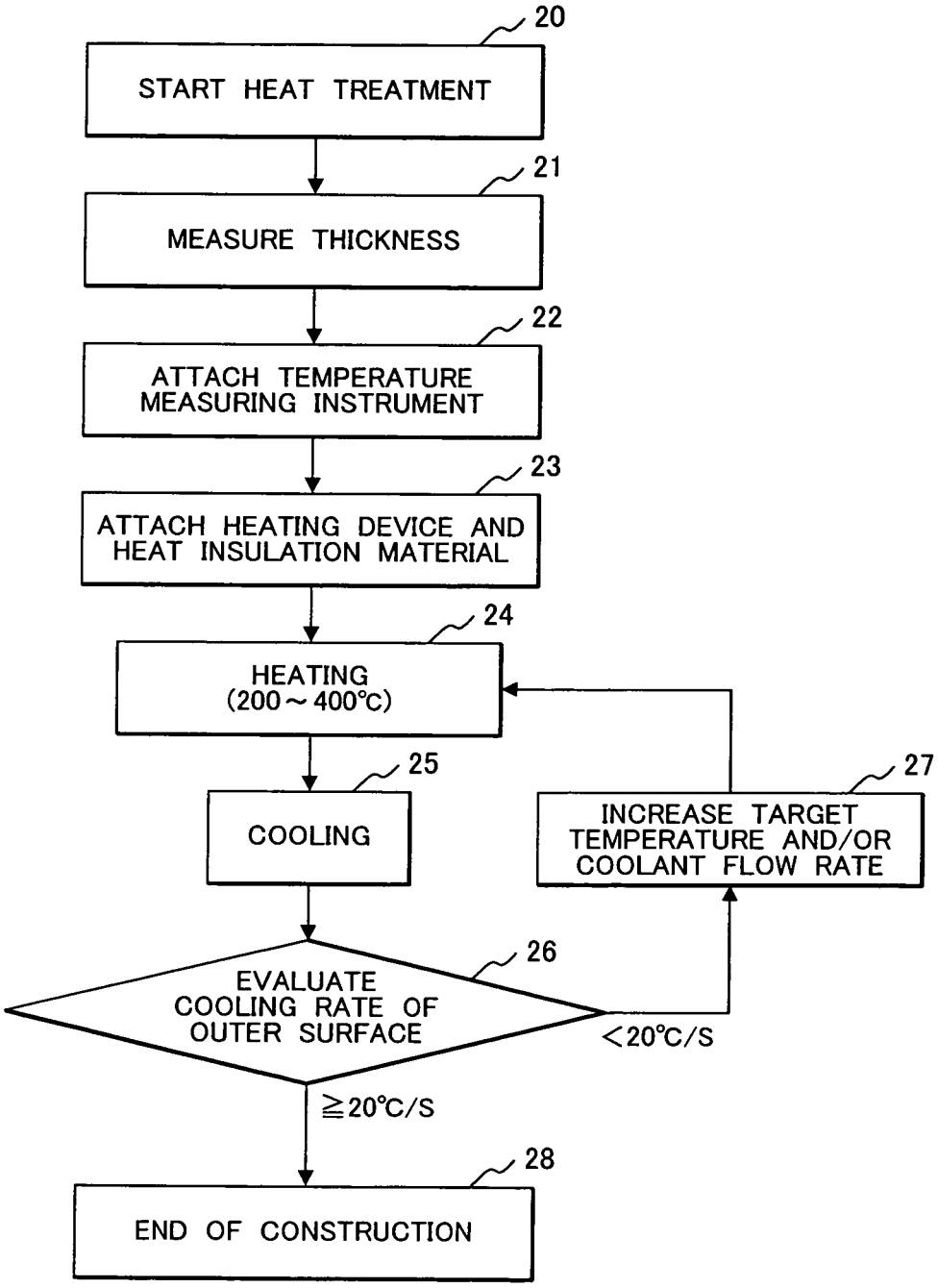
FIG. 2 is a flow chart of a heat treatment method of the pipe according to the present embodiment.
Figure 3:
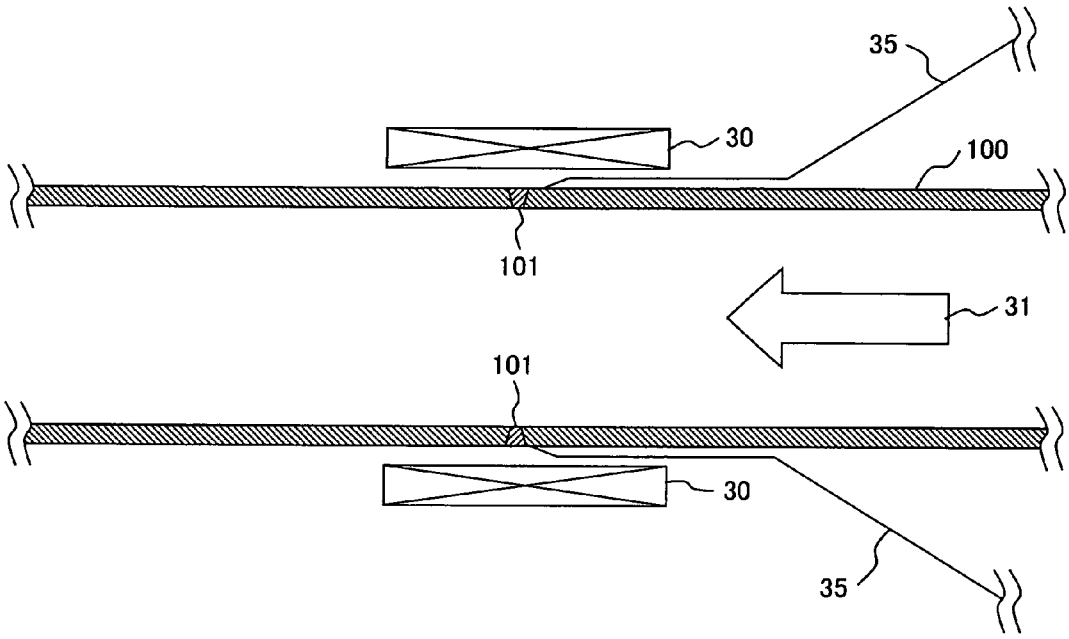
FIG. 3 is a schematic drawing of the pipe subjected to the heat treatment method and shows a cross-section in the longitudinal direction of the pipe according to the present embodiment.

FIG. 2 is a flow chart of a heat treatment method of the pipe according to the present embodiment. FIG. 3 is a schematic drawing of the pipe subjected to the heat treatment method and shows a cross-section in the longitudinal direction of the pipe.

In FIG. 3, a temperature measuring instrument 35, a heating device 30 and a heat insulation material (not shown) are attached to a heat treatment part 101 of a pipe 100 which is an object of heat treatment. A heater can be used as the heating device 30, for example. Coolant (cooling water in the present embodiment) is allowed to flow along the coolant flow direction 31 inside the pipe 100.

The heat treatment method for the pipe according to the present embodiment will be described referring to FIG. 2. The present heat treatment method includes a step 21 of measuring the thickness of the heat treatment part 101, a step 22 of attaching the temperature measuring instrument 35 to the heat treatment part 101, a step 23 of attaching the heating device 30 and the heat insulation material to the heat treatment part 101, a heating step 24 of heating the heat treatment part 101, a cooling step 25 of allowing the coolant to flow through the pipe 100, a step 26 of evaluating the cooling rate of the outer surface of the pipe 100, and a step 27 of increasing the target temperature and/or the flow rate of the coolant.

In the step 21 of measuring the thickness, the thickness is measured that is the position where the temperature measuring instrument 35 is attached to the heat treatment part 101 of the pipe 100 which is an object of heat treatment. The reason why the thickness is measured in the position where the temperature measuring instrument 35 is attached is that, in the step 26 of evaluating the cooling rate of the outer surface of the pipe 100, the cooling rate of the outer surface changes as the thickness differs. Accordingly, when variation in the thickness of pipes is large even though the pipes are of same specification, a correction coefficient of the thickness and the cooling rate of the outer surface should be obtained beforehand. On the other hand, when the thickness of the pipe 100 is known already, this step can be omitted.

In the step 22 of attaching the temperature measuring instrument 35, the temperature measuring instrument 35 is attached to a position nearest the heat treatment part 101.

When the temperature distribution in the peripheral direction of the pipe is to be managed, the temperature measuring instrument 35 is to be attached at least in one position in the peripheral direction, hopefully in four positions at equal intervals of 90° pitch. When the temperature measuring instrument 35 is attached only in one position in the peripheral direction, it should be in the hardest position to cool in the peripheral direction, for example in the top position in the case of a horizontal postured pipe to measure the temperature of the top position. In the case where the temperature measuring instruments 35 can be attached in two positions, if the temperature measuring instruments 35 are attached in the easiest position and the hardest position to cool, it is possible to confirm that there is no variation in the cooling rate of the outer surface in the peripheral direction. For example, in the case of a horizontal postured pipe, the temperature measuring instruments 35 are to be attached in two positions of the top position and the bottom position. When the temperature measuring instruments 35 can be attached in three positions or more, the temperature measuring instruments 35 are to be attached at equal intervals in the peripheral direction with reference to a hard position to cool. For example, when the temperature measuring instruments 35 can be attached in four positions, the temperature measuring instruments 35 are to be attached at 90° pitch with reference to the top position.

In the step 23 of attaching the heating device 30 and the heat insulation material, the heating device 30 and the heat insulation material are fixed so as to cover the heat treatment part 101. The heating range of the heating device 30 includes at least the entire cross-section in the radial direction of the pipe 100.

In the heating step 24, the heat treatment part 101 is heated and the temperature is raised to the target temperature. The target temperature can be set in the range of 200° C.-400° C. according to the purpose. For example, in the case of the pipe used at 300° C., making the target temperature 300° C. or below can prevent the material of the pipe 100 from being affected by heat treatment. When the residual stress in the heat treatment part 101 is large, a higher target temperature (heating temperature) is set according to the equation (1) as described above.

However, when the temperature exceeds 400° C., the material characteristic of the pipe 100 may possibly change due to a precipitate or a phase decomposition. Therefore, the maximum heat treatment temperature is to be 400° C. or below. When the target temperature is below 200° C., the temperature difference in the thickness direction is insufficient, and it is difficult to maintain the thermal stress required for improving the residual stress (changing to the compressive residual stress). Accordingly, the target temperature is set at 200° C.-400° C.

In the cooling step 25, when the heat treatment part 101 reaches the target temperature, the coolant (cooling water) with the flow rate required for cooling the pipe 100 is allowed to flow inside the pipe 100. Preferably, matching the diameter and the posture of the heat treatment part 101, the coolant with the flow rate capable of cooling the pipe 100 without temperature distribution in the peripheral direction is allowed to flow through the pipe 100. For example, the coolant is supplied to the pipe 100 under such a flow rate condition that the inside of the pipe 100 is sufficiently filled up with the coolant.

In the step 26 of evaluating the cooling rate of the outer surface, the temperature of the outer surface of the pipe 100 during cooling is constantly monitored by the temperature measuring instruments 35, and whether the cooling rate is equal to a predetermined value set beforehand or above is determined. According to the present embodiment, this predetermined value is set at 20° C./s. By this determination, it is judged whether the desired temperature difference could be produced in the thickness direction of the pipe 100. When the cooling rate is below the predetermined value, step 27 of increasing the target temperature and/or the flow rate of the coolant is executed. Step 26 of evaluating the cooling rate of the outer surface will be described below in detail.

In the step 27 of increasing the target temperature and/or the flow rate of the coolant, either one or both of the target temperature for heating the pipe 100 and the flow rate of the coolant allowed to flow inside the pipe 100 are increased. When one of the target temperature and the flow rate of the coolant is to be increased, the one to be increased can be arbitrarily selected. For example, when the heating temperature of the pipe 100 is a temperature near the upper limit of the target temperature, it is not possible to heat by raising the target temperature further, and therefore the flow rate of the coolant is increased.

When either one (or both) of the target temperature and the flow rate of the coolant is increased in the step 27 of increasing the target temperature and/or the flow rate of the coolant, the heating step 24 and the cooling step 25 are repeated, and it is determined whether the cooling rate has become a predetermined value set beforehand or above in the step 26 of evaluating the cooling rate of the outer surface. The cooling rate can be controlled so as to become a predetermined value set beforehand or above by repeating the heating step 24, the cooling step 25, and the step 27 of increasing the target temperature and the flow rate of the coolant until the cooling rate becomes a predetermined value set beforehand or above in the step 26 of evaluating the cooling rate of the outer surface as described above.

Here, the step 26 of evaluating the cooling rate of the outer surface will be described. In order to judge whether the desired temperature difference has been produced in the heat treatment part 101 in the cooling step 25, a change in the outer surface temperature is constantly measured using the temperature measuring instruments 35 and the cooling rate of the outer surface of the pipe 100 is evaluated from the change in the temperature in the step 26.

From the equation (1), the temperature difference $\Delta T$ in the thickness direction is necessary in order to calculate the thermal stress. When it is possible to attach the temperature measuring instruments 35 to the inner surface of the pipe 100 and the vicinity of the heat treatment part 101 before heat treatment, the temperatures of the outer surface and inner surface of the pipe 100 can be measured, and the temperature difference in the thickness direction can be directly obtained. However, in the facilities where the pipe is actually constructed, attaching the temperature measuring instruments 35 to the inner surface of the pipe 100 before the heat treatment is generally a difficult work.

Therefore, in order to manage the effect of improving the residual stress (changing to the compressive residual stress) by the heat treatment, a parameter is necessary to replace the temperature difference in the thickness direction of the pipe 100. From FIGS. 1A and 1B, it is found that the temperature difference 15 in the thickness direction changes with time with the same tendency as the temperature 10 of the outer surface and the cooling rate 16 of the outer surface.

Figure 4:
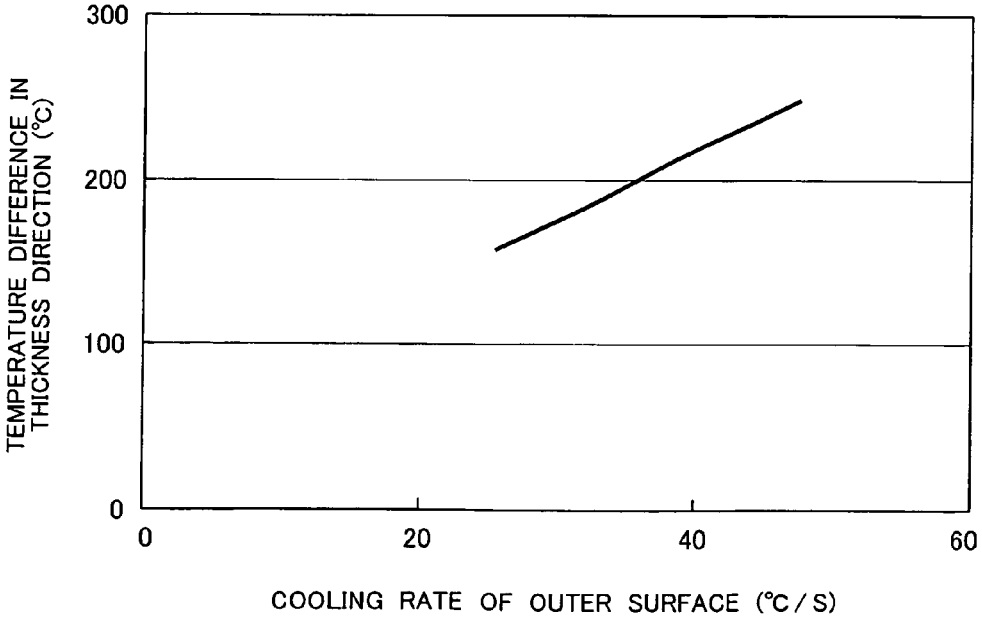
FIG. 4 shows a relation between the temperature difference in the thickness direction of the pipe and the cooling rate of the outer surface.

FIG. 4 shows a relation between the temperature difference in the thickness direction of the pipe and the cooling rate of the outer surface. When the cooling rate of the outer surface is plotted on the horizontal axis and the temperature difference in the thickness direction is plotted on the vertical axis, good correlation is seen between both of them as is apparent from FIG. 4. From this fact, evaluation of the temperature difference in the thickness direction is possible from the cooling rate of the outer surface of the pipe 100.

Accordingly, in the step 26 of evaluating the cooling rate of the outer surface shown in FIG. 2, it is evaluated whether the cooling rate of the outer surface of the pipe 100 is equal to the predetermined value set beforehand or above. When the cooling rate is equal to the determined value or above, it is judged that the desired temperature difference has been produced in the thickness direction of the pipe 100, and construction is finished.

For example, the case exemplarily shown in the present embodiment will be studied where the pipe is made of austenitic stainless steel and has the outside diameter of 200 mm or below and the thickness of 15 mm or below. Because the yield stress of austenitic stainless steel is approximately 200 MPa, the temperature difference in the thickness direction required for producing the thermal stress exceeding this stress is approximately 100° C. according to the equation (1). When the temperature difference in the thickness direction is 100° C., the cooling rate of the outer surface is 20° C./s, which is obtained from the result extrapolating the graph shown in FIG. 4 taking likelihood into consideration. Therefore, when the cooling rate of the outer surface is 20° C./s or above, improvement of the residual stress (changing to a compressive residual stress) of the pipe is possible. Accordingly, the predetermined value for evaluating the cooling rate of the outer surface is set beforehand at 20° C./s.

Consequently, in the case of the present embodiment, it is evaluated whether the cooling rate of the outer surface of the pipe is 20° C./s or above in the step 26 of evaluating the cooling rate of the outer surface shown in FIG. 2, the construction being finished when the cooling rate is 20° C./s or above.

Figure 5:
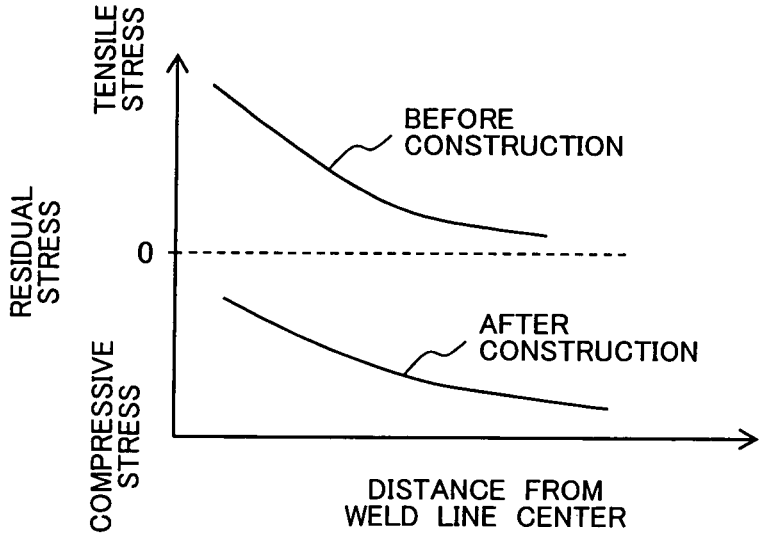
FIG. 5 shows an example of the residual stress distribution of the inner surface of a pipe subjected to the heat treatment method.

FIG. 5 shows an example of a result of a case in which a pipe of 50 A and Sch80 is subjected to the present heat treatment method and shows the residual stress distribution of the inner surface. The residual stress was measured by a strain relief method. In FIG. 5, the residual stresses before construction and after construction of the present heat treatment method are shown. It is found that the residual stress in the inner surface is plus, which is the tensile stress, before construction, whereas the residual stress is minus, which is the compressive stress, after construction. From this fact, it can be confirmed that a compressive residual stress field can be formed in the inner surface of the pipe by the present heat treatment method.

The heat treatment method in the method for improving a residual stress in a pipe was described above. Hereinafter, the method for improving a residual stress in a pipe and the method for construction management will be described.

The method for improving a residual stress in a pipe and the method for construction management according to an embodiment of the present invention have features described below.

The step of heating the vicinity of the welded part of the pipe to a predetermined construction temperature with a heater from the outer surface, thereafter supplying the cooling water into the pipe and rapidly cooling the inner surface is repeated at least twice or more. Preferably, the construction temperature is below 350° C. With respect to management during construction, the temperature difference between the inner and outer surfaces of the pipe is evaluated based on the lowering rate of the outer surface temperature when the cooling water is supplied to rapidly cool the inner surface of the pipe and the pipe thickness of the position for measuring the temperature, and it is confirmed that the thermal stress generated by the temperature difference between the inner and outer surfaces is equal to the yield stress of the pipe material or above. The outer surface temperature is measured by attaching the temperature measuring instrument, such as a thermo-couple for example, to the outer surface of the pipe in the vicinity of the welded part.

Hereinafter, the method for improving a residual stress in a pipe and the method for construction management according to an embodiment of the present invention will be described in detail.

The method for improving a residual stress according to an embodiment of the present invention is suitable particularly to a pipe with a small diameter. In the method for improving the residual stress according to an embodiment of the present invention, the step of heating the region of the vicinity of the welded part of the pipe or the inner surface of the pipe where the residual stress is required to be improved to the compressive direction to a predetermined construction temperature with a heater from the outer surface, thereafter supplying the cooling water into the pipe and rapidly cooling the inner surface (hereinafter, this step is referred to as "the rapid cooling after heating") is repeated at least twice or more. The construction temperature is preferably below 350° C. With this construction temperature, the effect of reducing the residual stress lowers compared with the case in which the rapid cooling after heating is performed at the construction temperature of 600° C. or above, for example. Thus, it may be considered that the tensile residual stress possibly remains in a part where the initial residual stress is locally high after the first rapid cooling after heating. However, the tensile residual stress remaining in the inner surface of the pipe can be changed to the compressive residual stress by the second rapid cooling after heating because the tensile residual stress that is locally high has been reduced by the first rapid cooling after heating.

In the method for improving a residual stress according to an embodiment of the present invention, in which the construction temperature is low, it is important to manage the improvement of the residual stress in the inner surface of the pipe by the rapid cooling after heating. Whether the residual stress in the inner surface of the pipe is improved is decided by whether the thermal stress generated in the inner surface of the pipe by the rapid cooling after heating exceeds the yield stress of the pipe material. Although the thermal stress generated in the inner surface of the pipe cannot be measured directly, the thermal stress generated in the inner surface of the pipe by the temperature difference between the inner and outer surfaces of the pipe can be evaluated by the formula on the thermal stress generated in the inner surface of a hollow cylindrical pipe shown in the equations (1) and (2) described above.

For example, when the temperature difference of 150° C. is provided between the inner and outer surfaces of the pipe made of austenitic stainless steel with the outside diameter of 60.5 mm and the thickness of 5.5 mm, and $\alpha$, E and $\nu$ are $15.14\times10^{-6}K^{-1}$, 195 GPa and 0.3 respectively, it is evaluated that the thermal stress of 337 MPa is generated in the inner surface of the pipe. In austenitic stainless steel used as a pipe material, such as SUS304 steel and SUS316 steel for example, the yield stress is below 337 MPa. Therefore, in the pipe made of austenitic stainless steel, plastic deformation in the tensile direction is generated in the inner surface of the pipe and the residual stress after construction can be improved to the compressive direction by providing the temperature difference of 150° C. between the inner and outer surfaces of the pipe.

With respect to the temperature difference between the inner and outer surfaces of the pipe, it may be occasionally hard to measure the temperature of the inner surface of the pipe during construction. Therefore, in the embodiment of the present invention, focusing the fact that the lowering rate of the temperature measured on the outer surface of the pipe is strongly correlated to the temperature difference between the inner and outer surfaces of the pipe and the pipe thickness, the temperature between the inner and outer surfaces of the pipe is evaluated based on the pipe thickness in the position for measuring the outer surface temperature and the temperature lowering rate of the outer surface of the pipe. More specifically, as the temperature difference between the inner and outer surfaces of the pipe increases, the temperature lowering rate of the outer surface of the pipe increases. As the pipe thickness increases, the temperature lowering rate of the outer surface of the pipe decreases.

By utilizing the physical properties described above, improvement of the residual stress in the inner surface of the pipe is determined based on the temperature lowering rate of the outer surface of the pipe when the cooling water is supplied to rapidly cool the inner surface of the pipe and the pipe thickness of the temperature measuring position, and then construction management is performed in the method for improving the residual stress in the inner surface in the vicinity of the welded part or the inner surface of the pipe in the method for construction management according to the embodiment of the present invention. Drop of the outer surface temperature occurring in water-cooling the inner surface of the pipe is a phenomenon finishing within a short time of several seconds. Therefore, in the method for construction management according to the embodiment of the present invention, the outer surface temperature of the pipe is preferably measured at 0.1 second or below intervals, and the temperature lowering rate of the outer surface of the pipe is evaluated from the measured outer surface temperature of the pipe.

Hereinafter, an embodiment of the method for improving a residual stress in a pipe and the method for construction management according to the present invention will be described in detail. The embodiment below will exemplify the case where the inner surface in the vicinity of a butt weld part of a pipe is selected as an object to be applied in the pipe made of austenitic stainless steel (SUS304 steel or SUS316 steel) with a small diameter.

Figure 6:
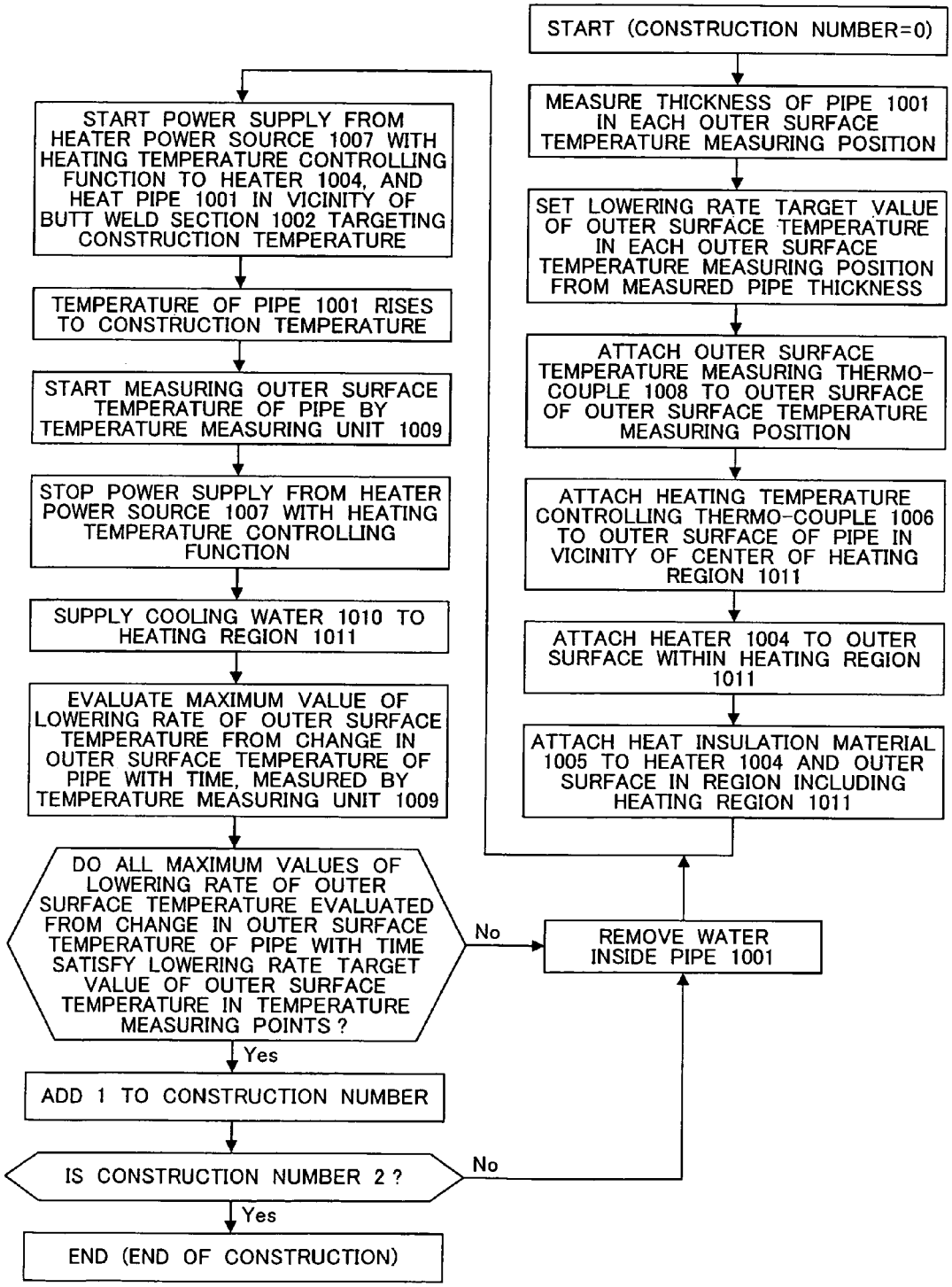
FIG. 6 is an explanatory drawing of a specific construction procedure with respect to the method for improving a residual stress according to the present embodiment.
Figure 7:
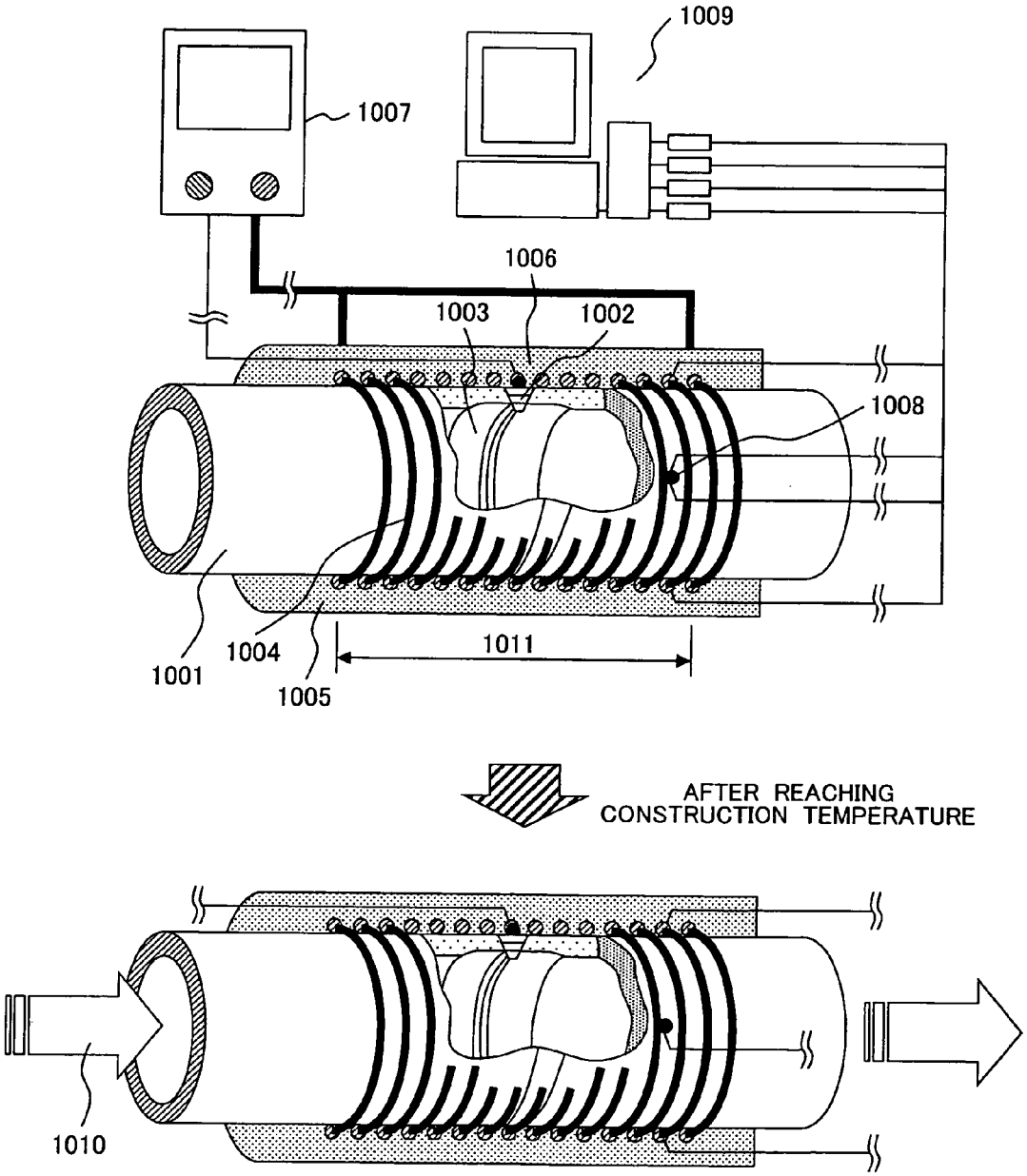
FIG. 7 is an explanatory drawing of a specific aspect when the method for improving a residual stress according to the present embodiment is applied to the vicinity of a butt welded part of a pipe.

With reference to FIG. 6 and FIG. 7, the method for improving a residual stress in a pipe and a method for construction management according to the present embodiment will be described. FIG. 6 is an explanatory drawing of a specific construction procedure with respect to the method for improving a residual stress according to the present embodiment. FIG. 7 is an explanatory drawing of a specific aspect when the method for improving a residual stress according to the present embodiment is applied to the vicinity of a butt welded part of a pipe.

First in the present embodiment, the thickness in at least one position of a pipe 1001 is measured where temperature of the outer surface is to be measured (hereinafter, the position is referred to as "the outer surface temperature measuring position"). It is preferable that the outer surface temperature measuring position is the outer surface of the pipe out of the region of an inner surface groove part 1003. The reason is that the lowering rate of the temperature measured in the outer surface of the pipe is strongly correlated to the pipe thickness, which changes continuously due to the curved surface in the inner surface groove part 1003.

Next, from the measured pipe thickness, a lowering rate target value of the outer surface temperature is set in each outer surface temperature measuring position. Because the lowering rate of the temperature measured in the outer surface of the pipe is strongly correlated to the temperature difference between the inner and outer surfaces of the pipe and the pipe thickness, the temperature difference between the inner and outer surfaces of the pipe can be evaluated from the lowering rate of the outer surface temperature when the pipe thickness is decided (see FIG. 2 and FIG. 4 for example). Thus, the temperature difference that generates a thermal stress sufficient to provide the inner surface with a tensile yield stress can be set as the lowering rate target value of the outer surface temperature.

Then, outer surface temperature measuring thermo-couple 1008 is attached to the outer surface temperature measuring position. The outer surface temperature measuring thermo-couple 1008 is to be attached in at least one position, hopefully in four positions at 90° intervals downstream a butt weld section 1002 with the supply side of cooling water 1010 being the upstream side.

Next, a heating temperature controlling thermo-couple 1006 is attached to the outer surface of the pipe. Because the heating temperature controlling thermo-couple 1006 preferably controls the highest heating temperature, it is attached to the outer surface in the vicinity of the center of a heating region 1011 where the heating temperature is considered to become highest.

Thereafter, a heater 1004 is attached to the outer surface within the heating region 1011.

Then, a heat insulation material 1005 is attached to the heater 1004 and the outer surface in a region including the heating region 1011. The heat insulation material 1005 is attached in order to improve the efficiency in heating the pipe 1001 by the heater 1004 and to improve the accuracy of evaluation of the temperature difference between the inner and outer surfaces of the pipe from the lowering rate of the outer surface temperature.

Next, power supply is started from a heater power source 1007 with heating temperature controlling function to the heater 1004, and the vicinity of the butt weld section 1002 in the pipe 1001 is heated targeting the construction temperature. In the present embodiment, from the viewpoint of shortening the construction time and preventing deterioration of the material, the construction temperature (the upper limit of the heating temperature for the pipe) is set to a low temperature of below 350° C.

After the temperature of the pipe 1001 is raised to the construction temperature, measurement of the outer surface temperature of the pipe is started by a temperature measuring unit 1009.

At this time, in order to reduce the measurement noise and improve accuracy in evaluation of the temperature difference between the inner and outer surfaces of the pipe from the lowering rate of the outer surface temperature, power supply from the heater power source 1007 with heating temperature controlling function is stopped and cooling water 1010 is supplied to the heating region 1011. The supply rate of the cooling water 1010 is to be made a flow rate at which the cooling water 1010 can reach the heating region 1011 under a fully filled condition.

In order to manage construction, the maximum value of the lowering rate of the outer surface temperature is evaluated from a change in the outer surface temperature of the pipe with time, measured by the temperature measuring unit 1009.

Figure 8:
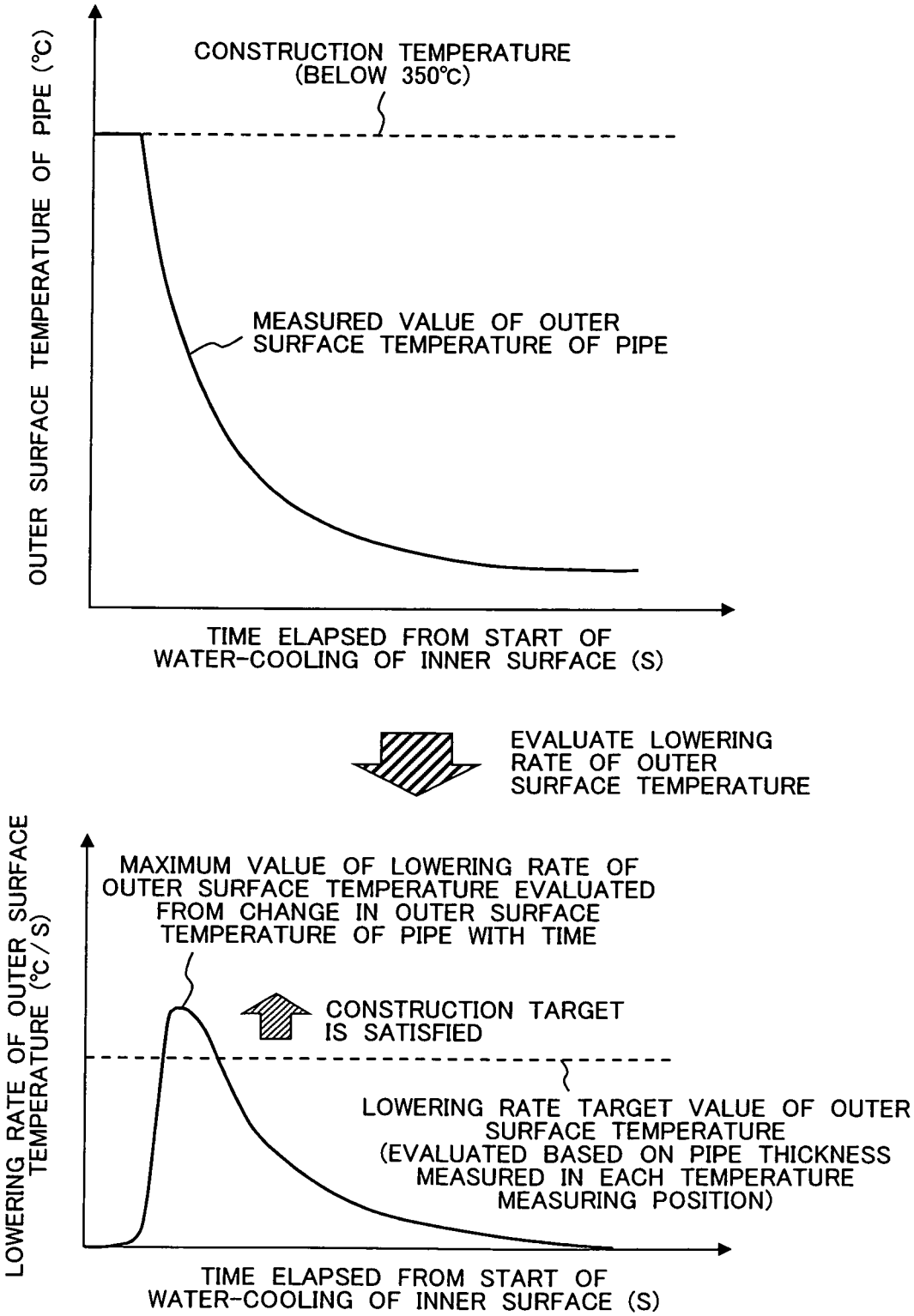
FIG. 8 is an explanatory drawing of a specific example of evaluating the temperature lowering rate from a change in the outer surface temperature of the pipe with time when the inner surface is water-cooled after heating the pipe in the method for improving a residual stress according to the present embodiment.

With reference to FIG. 8, a specific example will be described where the temperature lowering rate is evaluated from a change in the outer surface temperature of the pipe with time when the inner surface is water-cooled after heating the pipe in the method for improving a residual stress according to the present embodiment. A part of the pipe 1001 within the heating region 1011 is heated with the construction temperature (below 350° C.) being the upper limit temperature. When the cooling water 1010 is supplied into the pipe 1001 under this condition, the pipe 1001 is rapidly cooled from the inner surface. As shown in the upper graph of FIG. 8, the temperature of the outer surface of the pipe starts to drop after some interval from the start of a water-cooling of the inner surface.

With the small diameter pipe used in the present embodiment, sharp drop of the outer surface temperature finishes within a short time of several seconds because of the thin thickness of the pipe. Therefore, the outer surface temperature of the pipe is measured at 0.1 second or below intervals, and a change in the outer surface temperature of the pipe with time (that is, the lowering rate of the outer surface temperature) is evaluated from the temperature data of the outer surface of the measured pipe. Because the measurement interval is short, it is preferable that a moving average processing (averaging of approximately 5 points) is performed on the temperature data of the outer surface of the pipe used for evaluation of the lowering rate of the outer surface temperature.

Determination whether the construction is proper is evaluated by whether each of the maximum values of the lowering rate of the outer surface temperature, which is evaluated from the change in the outer surface temperature of the pipe with time, satisfies the lowering rate target value of the outer surface temperature (that is, whether the maximum value is greater than the lowering rate target value of the outer surface temperature) in all of the temperature measuring positions (see FIG. 6). The lowering rate target value of the outer surface temperature in each temperature measuring position differs depending on the pipe thickness measured in the position concerned. More specifically, when the thickness is thin, the lowering rate target value of the outer surface temperature tends to increase, whereas when the thickness is thick, the lowering rate target value of the outer surface temperature tends to decrease. The reason is that, even when the temperature difference between the inner and outer surfaces is same, the lowering rate of the measured outer surface temperature increases as the thickness is thinner.

As shown in the lower graph of FIG. 8, the lowering rate of the outer surface temperature evaluated in each temperature measuring position becomes the maximum after some interval from the start of the water-cooling of the inner surface, and thereafter gradually drops as the time elapses. In the method for improving the residual stress in a small diameter pipe according to the present embodiment, the residual stress is improved to the compressive direction by providing the inner surface of the pipe with a plastic deformation in the tensile direction, the thermal stress generated by transitional temperature distribution exceeding the yield stress of the pipe material. Therefore, when all of the maximum values of the lowering rate of the outer surface temperature evaluated in the respective temperature measuring positions are greater than the lowering rate target value of the outer surface temperature, the lowering rate target value of the outer surface temperature (construction target) is satisfied, which means that the residual stress has been improved in the respective temperature measuring positions.

In the present embodiment, the aim of which is to change the residual stress in the entire periphery of the inner surface of the pipe to a compressive residual stress, the case is evaluated to be a proper construction where the construction target is satisfied in all of the temperature measuring positions. However, when only the residual stress of a specific angle is changed to a compressive residual stress, the case is evaluated to be a proper construction where the construction target is satisfied in the temperature measuring position of the angle concerned.

In the method for improving a residual stress in a small diameter pipe according to the present embodiment, the step of supplying the cooling water into the pipe and rapidly cooling the inner surface is repeated at least twice. Therefore, in the determination whether the construction is proper (that is, in the determination whether the maximum value of the lowering rate of the outer surface temperature satisfies the lowering rate target value of the outer surface temperature), when the construction is evaluated to be proper in the determination (that is, when the maximum value of the lowering rate satisfies the lowering rate target value), 1 (one) is added to the construction number, as shown in FIG. 6. When the construction is evaluated not to be proper in the determination (that is, when the maximum value of the lowering rate do not satisfy the lowering rate target value), the construction number remains 0.

Thereafter, the water inside the pipe 1001 is removed, and the rapid cooling after heating of the pipe 1001 is repeated until the construction number becomes 2 (two).

Figure 9:
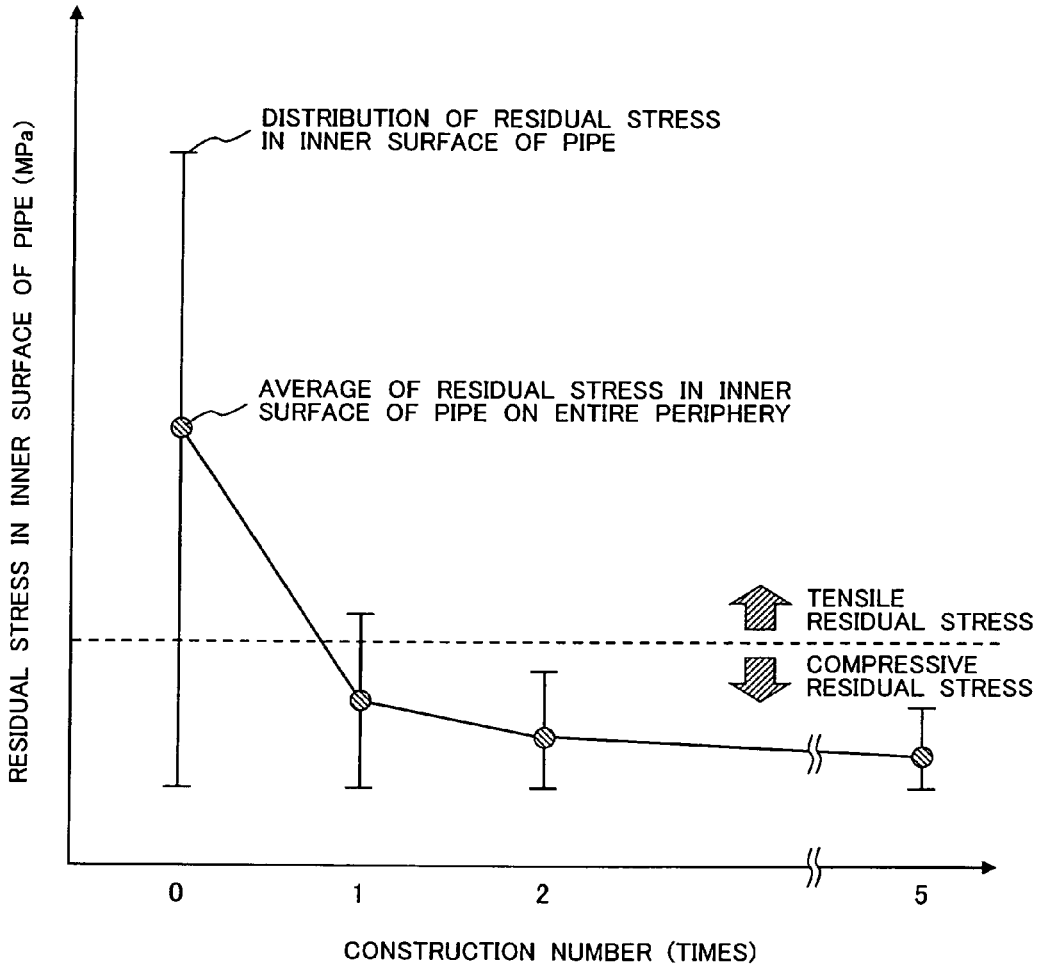
FIG. 9 is an explanatory drawing of a specific example of the residual stress improvement effect obtained by applying the method for improving a residual stress according to the present embodiment.

With reference to FIG. 9, a specific example will be described of the residual stress improvement effect obtained by applying the method for improving a residual stress according to the present embodiment. According to the present embodiment, in which the construction temperature is as low as below 350° C., the residual stress improvement effect is inferior compared with the case in which the rapid cooling after heating is performed at the construction temperature of 600° C. or above, for example. As a result, even when the residual stress becomes a compressive residual stress in average after the first construction (the rapid cooling after heating), the tensile residual stress may remain in a part where the initial residual stress is locally high. However, the tensile residual stress remaining in the inner surface of the pipe can be changed to a compressive residual stress by the second construction because locally high tensile residual stress is reduced by the first construction.

When the pipe material is austenitic stainless steel, the absolute value of the stress at which the pipe starts tensile yield and compressive yield increases due to work hardening by repeated construction, and therefore, it is considered that the maximum value of the residual stress also increases and the residual stress reducing effect is also enhanced.

Due to these reasons, the residual stress which has been applied to the inner surface of the pipe after welding, the variation of which among the positions is large and the average value of which is in the tensile range, reduces its variation among the positions and also improves its average value to the compressive direction as the construction number increases.

What is claimed is:

1. A method for improving a residual stress in a pipe, comprising:

improving the residual stress in an inner surface of the pipe to the compressive direction by cooling of the inner surface of the pipe after heating of the pipe;

wherein the heating is to heat a vicinity of a welded part of the pipe from an outer surface of the pipe to raise the temperature to a construction temperature below 350° C., the cooling is to cool the inner surface in the vicinity of the welded part of the pipe by supplying cooling water into the pipe, the heating and the cooling are repeated twice or more, an outer surface temperature of the pipe is measured using a temperature measuring unit when the cooling water is supplied for the cooling of the inter-surface, and it is determined whether a maximum value of a lowering rate of the outer surface temperature of the pipe, obtained without inner surface temperature measurement, satisfies a lowering rate target value of the outer surface temperature, the lowering rate target value being a function of a thickness of the pipe in a measuring position of the outer surface temperature.

2. The method for improving a residual stress in a pipe according to claim 1, wherein a material of the pipe is austenitic stainless steel.

3. The method for improving a residual stress in a pipe according to claim 1, wherein the outer surface temperature of the pipe is measured at intervals of 0.1 second or below when the cooling water is supplied for the cooling of the inner surface.

4. The method for improving a residual stress in a pipe according to claim 3, wherein the outer surface temperature of the pipe is measured out of a region of an inner surface groove part of the pipe.

5. The method for improving a residual stress in a pipe according to claim 1, wherein the cooling rapidly cools the inner surface creating a temperature difference between the inner and outer surfaces generating thermal stress equal to or above the yield stress of the pipe material.

6. A method for improving a residual stress in a pipe made of austenific stainless steel, comprising the steps of:

heating a heat treatment part of the pipe;

cooling an inner surface of the pipe by a coolant after the step of heating the heat treatment part;

obtaining a cooling rate of an outer surface of the pipe, without inner surface temperature measurement; and controlling the cooling rate, wherein the step of heating the heat treatment part includes heating the heat treatment part so as to reach a target temperature using a heating device, the step of cooling the inner surface includes cooling the inner surface of the pipe by allowing the coolant to flow inside the pipe after the temperature of the heat treatment part reaches the target temperature, the step of obtaining the cooling rate includes obtaining a temperature of the outer surface of the pipe using a temperature measuring instrument attached to the outer surface of the heat treatment part of the pipe, obtaining the cooling rate of the outer surface of the pipe from a temperature change of the outer surface of the pipe when cooling the inner surface of the pipe, the step of controlling the cooling rate includes, when the cooling rate is lower than a predetermined cooling rate, repeating the step of heating the heat treatment part and the step of cooling the inner surface with changing at least either one of the target temperature and a flow rate of the coolant so that the cooling rate becomes the predetermined cooling rate or above, and the predetermined cooling rate is determined using a temperature difference in a thickness direction of the pipe and a preliminarily obtained relation between the temperature difference in the thickness direction of the pipe and a cooling rate of the outer surface of the pipe, the temperature difference in the thickness direction of the pipe being obtained from an outside radius, a thickness, a yield stress, a coefficient of thermal expansion, Young's modulus, and a Poisson's ratio of the pipe.

7. The method for improving a residual stress in a pipe made of austenific stainless steel according to claim 6, wherein the step of controlling the cooling rate includes increasing at least either one of the target temperature and the flow rate of the coolant so that the cooling rate becomes the predetermined cooling rate or above.

8. The method for improving a residual stress in a pipe made of austenific stainless steel according to claim 6, wherein the pipe has an outside diameter of 200 mm or below and a thickness of 15 mm or below.

9. The method for improving a residual stress in a pipe made of austenific stainless steel according to claim 8, wherein the predetermined cooling rate is 20° C./s.

10. The method for improving a residual stress in a pipe made of austenific stainless steel according to claim 6, wherein the target temperature is 200° C.-400° C.

* * * * *